United States Patent [19]

Werber

[11] Patent Number: 4,883,186

[45] Date of Patent: Nov. 28, 1989

[54] EASY ERECTING TELESCOPIC MAST

[76] Inventor: Manuel M. Werber, 41 Brookside Ter., North Caldwell, N.J. 07006

[21] Appl. No.: 189,338

[22] Filed: May 2, 1988

[30] Foreign Application Priority Data

Oct. 28, 1987 [IL] Israel ..... 84299

[51] Int. Cl.[4] ..... B66C 23/06

[52] U.S. Cl. ..... 212/184; 212/267

[58] Field of Search ..... 212/182, 183, 184, 185, 212/266, 267, 268

[56] References Cited

U.S. PATENT DOCUMENTS

| | | | |
|---|---|---|---|
| 3,817,397 | 6/1974 | Neuman | 212/184 |
| 4,169,338 | 10/1979 | Eik | 212/267 |
| 4,298,128 | 11/1981 | Gattu | 212/267 |
| 4,309,854 | 1/1982 | Vendramini | 212/267 |
| 4,327,533 | 5/1982 | Sterner | 212/267 |
| 4,575,976 | 3/1986 | McDermott | 212/269 |
| 4,690,290 | 9/1987 | Gustafsson | 212/269 |

*Primary Examiner*—Sherman D. Basinger
*Assistant Examiner*—Stephen P. Avila
*Attorney, Agent, or Firm*—Browdy and Neimark

[57] ABSTRACT

A system for the raising and lowering of telescopic masts which operates in one of two general ways, the first way of which includes an attached jack which pulls rather than pushes to effect erection of the mast and the second way where an external turning motion is translated into an internal turning motion which causes the telescopic mast sections to be pushed from the bottom to effect erection of the mast.

7 Claims, 4 Drawing Sheets

EASY ERECTING TELESCOPIC MAST

FIELD OF INVENTION

This invention relates to the erecting of telescopic masts, and more particularly to a telescopic mast including a jack for erecting of the telescopic mast.

BACKGROUND OF THE INVENTION

Known systems for erecting telescoping masts invariably work on the principle of pushing each section above its preceding section. These systems suffer from at least one of the disadvantages of undue complexity and lack or reliability.

SUMMARY OF THE INVENTION

It is an object of the invention to overcome deficiencies in the prior art, such as indicated above.

It is another object of this invention to provide an improved, simple and reliable system for erecting telescoping masts.

It is a further object of this invention to provide an easily operable system for erecting telescoping masts (1) which operates on the principle of pulling sections from the top rather than pushing from the bottom, or (2) which operates inside the mast.

It is a still further object of this invention to provide a telescoping mast including a jack to erect the telescopic mast.

A first system of the present invention comprises a jack which is attached to the telescopic mast and becomes a part of it. By operating the handle of the jack and connecting an upper part/section of the mast to the jack, the upper section is lifted. When reaching its required height, the upper part is locked, and the jack is lowered to its initial position. It is then connected to the second part/section and lifted to its required height, locked and lowered. This procedure is repeated as many times as required achieving the desired extended length of the mast.

In a second system, the motion from the jack is translated to the inside of the telescopic mast system, thus allowing each section to be lifted to its required position and locked into place.

The above and other objects and the nature and advantages of the present invention will be more apparent from the following detailed description of various detailed embodiments as set forth below in conjunction with the drawing, wherein:

DETAILED DESCRIPTION OF PREFERRED EMBODIMENTS

Figure 1:
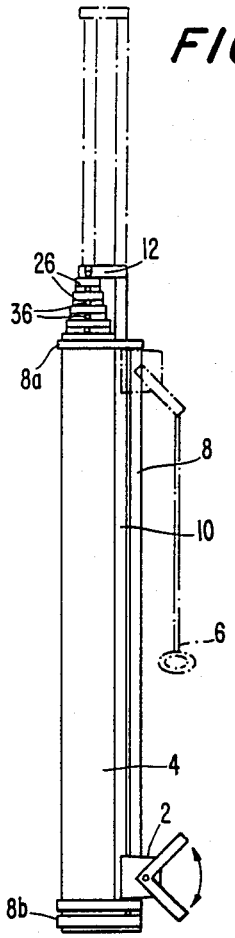
FIG. 1 is a schematic representation of an embodiment of the present invention, including a mechanical jack movable up and down along the outside of a telescopic mast.

As shown in FIG. 1, one embodiment of the present invention includes a mechanical jack 2 which is affixed to the outside of a bottom/outer section of a telescopic mast 4 by means of a toothed rod or rack 8, which is attached at its ends to the outer side of the bottom/outer section 4 by means of suitable retainer rings 8*a* and 8*b* or the like. The toothed rod or rack 8 can be replaced by a stepped strip or a screw, and indeed the rack 8 can even be replaced by a smooth rod or pole if the jack 2 is equipped with suitable gripping jaws.

Another elongated rod 10 is fixed at its bottom end to the jack 2 and is lifted with the jack 2 by operating the jack 2 so it moves upwardly along the rack 8. This guided rod 10 has attaching clamp arms 12 at its top to be engaged sequentially with the top part of each section of the mast which is to be pulled out to its full length by operating the jack. The retainer ring 8*a* may be provided with a suitable opening through which the elongated rod 10 is guided to maintain support and parallelism.

Once the upper section of the mast is pulled to its required height, the section is locked in any suitable way; the attaching clamp arms 12 are disengaged, and the jack 2 and rod 10 are lowered to their initial position. The attaching clamp arms 12 are then connected to the second mast section, and then the second section is lifted to its required height, locked, and the jack lowered.

This procedure is repeated as many times as necessary to achieve the required extended length of the mast. Thus, the sections are lifted by pulling from the top instead of pushing from the bottom. An elongated handle 6 is provided for operating the jack when it is in the higher positions. In this fashion, the telescopic mast can be raised to its full height even when the jack 2 itself is out of the reach of the operator.

Figure 2:
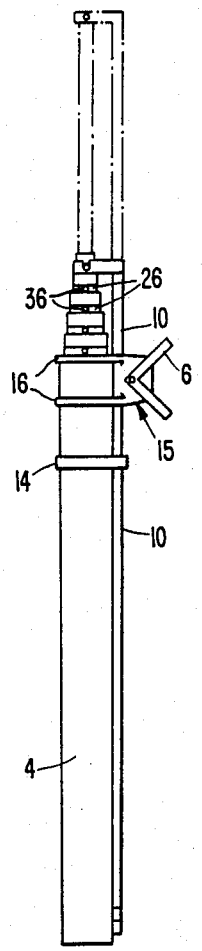
FIG. 2 is a schematic representation of a second embodiment of the present invention, where a mechanical jack is permanently attached to the upper and outside part of the bottom section of a telescopic mast.

FIG. 2 shows an alternative embodiment of the present invention wherein a jack 15, which may suitably be mechanical, is attached permanently via attaching rings 16 or the like to the upper and outside part of the lower/outer section 4 of the telescopic mast. A suitable guide 14 is desirably provided for the elongated rod 10 to maintain support and parallelism. A handle 6 (as shown in FIG. 1) is provided for operation of the jack.

Figure 3A:
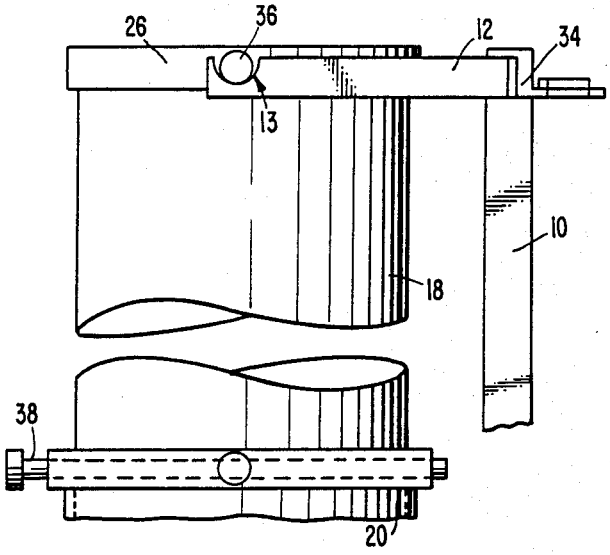
FIG. 3A is a horizontal side view schematic represention of a clamping and lifting mechanism for use in conjunction with the embodiment of FIGS. 1 and 2.
Figure 3B:
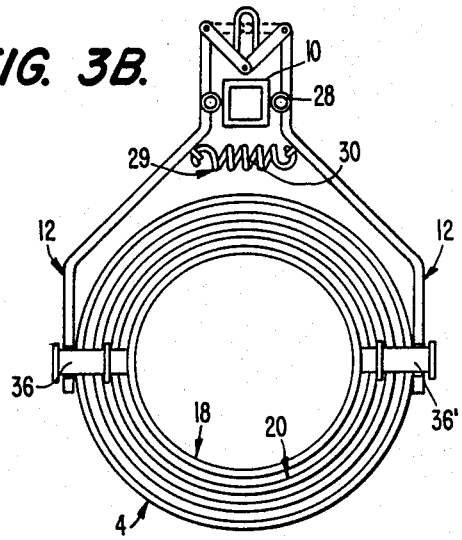
FIG. 3B is a schematic top view of the clamping mechanism shown in FIG. 3A.

The operation of a suitable clamping mechanism for lifting the mast of FIG. 2 is shown in FIGS. 3A, 3B, 3C and 3D. FIG. 3A shows two tube sections of the telescopic mast, the small tube section 18 being raised out of the next larger tube section 20, which is next in line to be raised. FIG. 3B shows a top view of four tube sections including the two smallest tube sections 18 and 20. The smallest diameter tube section 18 is lifted out first, followed by each next larger diameter tube section. The outer/lowest tube section 4 is not raised but instead remains in place to form the base of the telescopic mast.

Figure 3C:
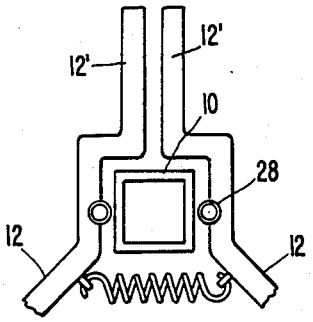
FIG. 3C is a schematic view showing the gripping of clamps which is an alternative embodiment of the clamping mechanism shown in FIG. 3A.
Figure 3D:
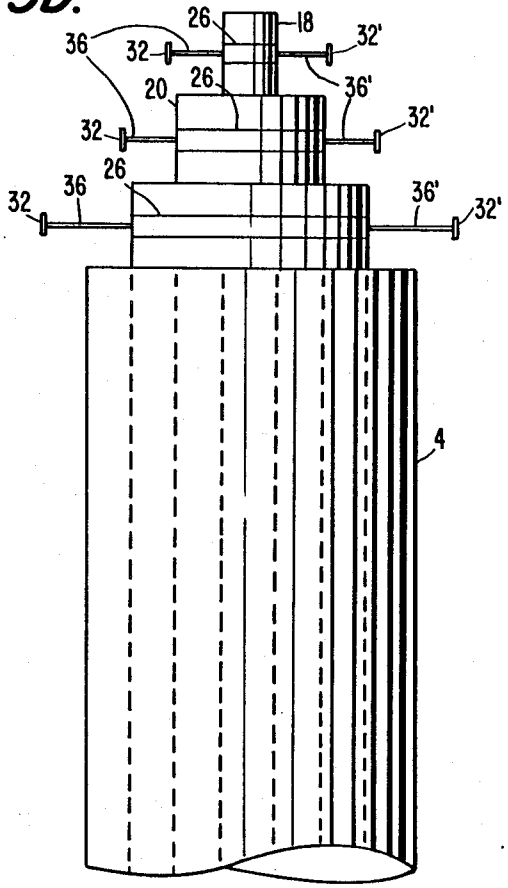
FIG. 3D is a schematic view showing four sections of the telescopic mast including protruding lifting hubs on each section for use in conjunction with the embodiment of FIGS. 1 and 2.

As shown more clearly in FIG. 3D, each tube (except the outermost tube 4) has its own set of opposed outwardly extending hubs 36, 36' with knobs 32, 32' at the end of the hubs 36, 36' to prevent the attaching clamps 12 from slipping off. Each set of hubs 36, 36' is attached to a ring 26 which is secured onto the upper end of each tube of the telescoping mast. Each tube has its own ring 26 and each ring 26 is successively smaller in diameter so that it tightly grasps its particular tube, starting with the largest diameter tube 4 at the bottom going upward to the smallest diameter tube 18 at the top. The bottom/outer tube 4 is the only one without a ring 26 and a set of hubs 32, 32' attached to it, since there is no need to raise such outer tube 4.

The attaching clamps are aligned so that the slotted areas 13 of the attaching clamp arms 12 are situated directly underneath the two hubs 36, 36' of the tube section of the telescopic mast to be raised. To facilitate the operation of the clamping mechanism, a set of hinges 28 can be utilized to swing the clamp arms 12 towards and away from the hubs 36, 36'. The hinges 28 enable the clamp arms 12 to pivot so that the distance therebetween corresponds to the various sets of hubs 36, 36' for the different tube sections. Desirably a compression coil spring 29 is provided to bias the clamp arms 12 apart. Once the slotted areas 13 of the attaching clamp arms 12 and the hubs 36, 36' are properly aligned, the tube section can be raised to its highest position. The tube section is then locked into place using a pin 38 which is inserted through the ring 26 of the next larger tube passing through the bottom of the smaller tube section just raised. Next the distance between the clamp arms 12 is widened to accommodate next larger and lower tube section. Then the lifting device, including the clamp arms 12 and the lifting rod 10, is lowered and secured to the next larger tube section so that it can be raised up next. This process is repeated until the telescopic mast reaches the desired height.

The securing of two adjacent tubes together can alternatively be accomplished using other well known securing methods of clamping, screwing, sliding, or any other securing means instead of the pins 38.

Possible alternative variations of the clamping mechanism include having a mechanism 34 (see FIG. 3A) to simultaneously open one clamp arm 12 while the other clamp arm 12 is being swung. Another possibility is to have both arms 12 of the clamp swing together by squeezing together the back parts 12' of the clamp arms as shown in FIG. 3C.

Figure 4:
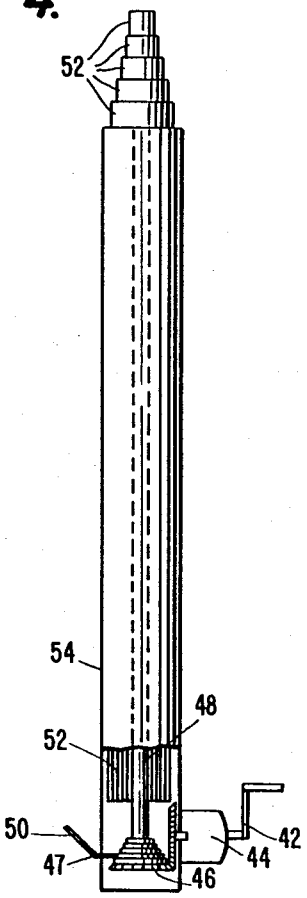
FIG. 4 is a schematic representation of a third embodiment of the present invention, partly broken away, where the lifting mechanism is inside the mast.

FIG. 4 illustrates a third embodiment of the present invention. In this embodiment, the lifting mechanism is inside the mast and the lifting is caused by a pushing force from the bottom of each tube section instead of a pulling motion from the top of each tube as disclosed in the above described embodiments. The lifting is done through a gear 44 with a handle 42 which is outside the bottom/outside mast section 54. The movement of the handle 42 is transferred inside where a geared wheel 46 is turned along with a threaded rod 48 and the nutted masts disks 47 having the diameter of the tube to be lifted. By pushing down on an engaging handle 50, the nutted disks 47 are forced up where they are engaged on the long threaded rod 48 where they sequentially engage the tubes 52 inside the mast where the tubes 52 are pushed one by one to their maximum height and then secured with a locking device such as the pin previously described which is on each of the individual mast tubes.

The smallest diameter disc 47 is engaged first and as the disc 47 spins around the threaded rod 48, the smallest diameter tube is pushed by the first/top smallest disc 47 all the way up to its fully extended position. It is then locked in place and the next larger disc is engaged using engaging handle 50 and the corresponding tube section is raised. This process is repeated until the telescopic mast is raised to the desired height. This same mechanism can be used regardless of the cross-sectional shape of the tube. Some of the other cross-sections besides round which may be used in the present invention include hexagonal or octagonal.

All of these masts are posted either on the ground using guy wires or some other means of support, or are attached to a vehicle. Guy wires may or may not be used for securing the mast in a vertical position.

Figure 5A:
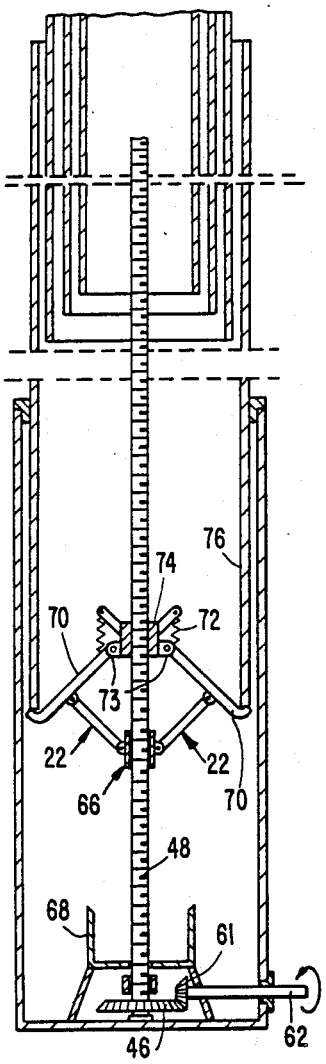
FIGS. 5A and 5B are schematic interior representation of the inner lifting mechanism for a fourth embodiment of the present invention.
Figure 5B:
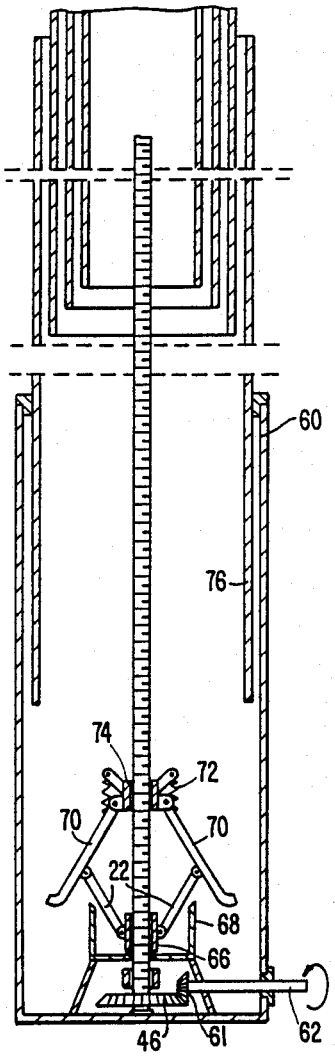

An alternative version of the telescopic mast with the lifting mechanism on the inside is shown in FIGS. 5A and 5B. The system is operated by turning the rotating mechanism 62 either manually or with a motor. The turning motion causes gears 61 and 46 to rotate which thereby causes the threaded rod 48 to rotate and lift nut 74. Two or more lifting arms 70 are secured with hinges 73 to the nut 74 and are expanded outwards by spring 72. The outward expansion causes the lifting arms 70 to be pressed against the tube having the smallest diameter as shown in FIG. 5A. When the threaded rod 48 is activated, the nut 74 is lifted and lifts the lifting arms 70, which become engaged with the tube, thus lifting the tube for as long as required. When the nut 74 reaches the desired position, pins may be used to secure the tube in its extended position as was done in the other embodiments.

The rotating mechanism 62 is then turned in the opposite direction causing the threaded rod 48 to rotate in the opposite direction which in turn causes the lift nut 74 to go down bringing the lift arms 70 with it. The lift arms 70 will be rubbing against the next larger diameter tube as they go down. When they reach the bottom of the next larger diameter tube, the lift arms 70 will catch the bottom of the next larger diameter tube and then that tube can be raised to its highest extent and locked in place. This procedure is repeated until the telescopic mast reaches the desired height.

For lowering the mast, the threaded rod 48 is activated for lifting a small amount, enabling the release of the holding pin. The direction of the threaded rod 48 can then be reversed, thus allowing the telescopic tube to be lowered, while being held by the lifting arms 70, as the nut 74 moves down the threaded 48. As shown in FIG. 5B, a mechanism 68 is used to contract the lifting arms 70 by forcing the small arms 22 to contract thus pulling the lifting arms 70 in also. The guide sleeve 66, which is not threaded, holds the small arms 22. The small arms 22 are contracted when the descending lift nut 74 forces them into contact with a shrinking piece 68. This causes the lifting arms 70 to disengage from tube 76 or any other tube which it may be holding. By activating the threaded rod 48, the nut 74 is lifted and the lifted and the lifting arms 70 are held together for a short distance while they pass by the bottom of tube 76 (while not engaging with it). The lifting arms 70 will then be forced up against the inside of the tube 76 and they will rub against the tube 76 as they ascend up with the lifting nut 74 to catch the next smaller tube and bring it down in the same fashion. This procedure is repeated until each tube has been brought down thus returning the telescopic mast to its storage position.

The precise nature of the jacks does not form a part of this invention, i.e. any suitably strong and secure jacks can be used, whether manual or motor powered. Thus, while the illustrated embodiments of the present invention are shown to be powered manually, they can also be driven by the power of a motor.

The preceding embodiments are shown only as examples of the many possible ways in which the present invention could be used. The invention is not intended to be limited to these embodiments.

What is claimed is:

1. A self-erecting telescopic mast comprising a plurality of hollow concentric mast sections including a bottom/outer mast section and further sections having an increasingly smaller diameter with respect to the diameter of the bottom/outer mast section;

a mechanical erecting means for erecting each mast section relative to a next outer section, said erecting means comprising an elongated element mounted relative to said bottom/outermost mast section exterior to the mast sections, and a jacking means for movement relative to said elongated element, said jacking means being adapted to travel upwardly along the length of said elongated element and including a second elongated element having clamping means at an upper end thereof for pulling each mast section upwardly from its next surrounding mast section by clamping the mast section at a top end thereof; and locking means for fixing each mast section relative to its next adjacent section in erected position.

2. A mast according to claim 1 wherein said jacking means is mounted on said bottom flash outer mast section at an upper portion thereof, and said jacking means (15) is adapted to drive said elongated element (10) relative thereto.

3. A mast according to claim 1 wherein each said mast section other than said bottom/outer mast section comprises hub support means (36, 36') at an upper end thereof, and said clamping means comprises at least one hinged clamp arm capable of radial movement relative to said mast sections for engagement with said hub support means.

4. A self-erecting telescopic mast comprising a plurality of hollow concentric mast sections including a bottom/outer mast section and further sections having an increasingly smaller diameter with respect to the diameter of the bottom/outer mast section;

a mechanical erecting means for erecting each mast section relative to a next outer section, said erecting means comprising an elongated element mounted relative to said bottom/outermost mast section internally to the mast sections, and a jacking means for movement relative to said elongated element, said jacking means being adapted to travel upwardly along the length of said elongated element and comprising a plurality of disks corresponding in diameter to the diameters of the mast sections for pushing each mast section upwardly from its next surrounding mast section by engaging a bottom inside portion of each section; and locking means for fixing each mast section relative to its next adjacent section in erected position.

5. A mast according to claim 4, further comprising:

gear means connected to said elongated element for rotating said element;

a first handle connected to said gear means for rotating said gear means;

a second handle selectively engageable with each of said disks for pushing each disk upwardly to engage the corresponding mast section, wherein after each disk is engaged with the corresponding mast section, the first handle is rotated causing, via said gear means, said elongated element to rotate and causing thereby, the movement of the disk upwardly along the elongated element.

6. A self-erecting telescopic mast comprising a plurality of hollow concentric mast sections including a bottom/outer mast section and further sections having an increasingly smaller diameter with respect to the diameter of the bottom/outer mast section;

a mechanical erecting means for erecting each mast section relative to a next outer section, said erecting means comprising an elongated element mounted relative to said bottom/outermost mast section internally to the mast sections, and a jacking means for movement relative to said elongated element, said jacking means being adapted to travel upwardly along the length of said elongated element and comprising a plurality of lifting arms adapted to be expanded radially outwardly from said elongated element so as to be inclined with respect to said elongated element for pushing each mast section upwardly from its next surrounding mast section by engaging a bottom portion of each section; and locking means for fixing each mast section relative to its next adjacent section in erected position.

7. A mast according to claim 6, further comprising:

gear means connected to said elongated member; and a handle connected to said gear means for rotating said elongated member and thereby moving said jacking means upwardly along said elongated member.

* * * * *